US008074828B2

(12) United States Patent
Hartley et al.

(10) Patent No.: US 8,074,828 B2
(45) Date of Patent: Dec. 13, 2011

(54) BULK CONTAINER CORNER SLING ADAPTER

(75) Inventors: Michael Dean Hartley, Beatrice, NE (US); Scott T. Meints, Houston, TX (US)

(73) Assignee: Hoover Materials Handling Group, Inc., Alpharetta, GA (US)

( * ) Notice: Subject to any disclaimer, the term of this patent is extended or adjusted under 35 U.S.C. 154(b) by 260 days.

(21) Appl. No.: 12/454,982

(22) Filed: May 27, 2009

(65) Prior Publication Data

US 2009/0314791 A1 Dec. 24, 2009

Related U.S. Application Data

(60) Provisional application No. 61/132,471, filed on Jun. 19, 2008.

(51) Int. Cl.
*B65D 25/10* (2006.01)
*B65D 53/00* (2006.01)
*B65D 81/24* (2006.01)

(52) U.S. Cl. ..... 220/751; 294/68.1

(58) Field of Classification Search ..... 220/694, 220/729, 751; 294/68.1, 68.3, 82.1
See application file for complete search history.

(56) References Cited

U.S. PATENT DOCUMENTS 3,617,085 A * 11/1971 Modrey ..... 294/82.1
4,646,928 A * 3/1987 Ono et al. ..... 220/6
4,684,034 A * 8/1987 Ono et al. ..... 220/6
4,726,486 A * 2/1988 Masuda ..... 220/1.5

* cited by examiner

*Primary Examiner* — Harry Grosso
(74) *Attorney, Agent, or Firm* — Wood, Phillips, Katz, Clark & Mortimer

(57) ABSTRACT

A bulk container for storing materials comprises a tank having a peripheral side wall connected to a generally rectangular top wall. A lifting lug is secured to the tank at each corner of the top wall. Each lifting lug comprises a generally L-shaped metal plate having first and second legs. A corner sling adapter is mounted at each lifting lug. Each corner sling adapter includes a stiffener plate having a base connected to upturn sides and a padeye comprising a planar body with a through opening. The padeye planar body is secured to and extends upwardly from the base. Each corner sling adapter is fastened to one of the corner lifting lugs whereby the padeye planar body at each corner of the top wall is substantially in-line with the padeye planar body at an opposite corner of the top wall.

21 Claims, 3 Drawing Sheets

BULK CONTAINER CORNER SLING ADAPTER

CROSS REFERENCE TO RELATED APPLICATIONS

This application claims priority of provisional application No. 61/132,471, filed Jun. 19, 2008.

FIELD OF THE INVENTION

The present invention relates to a bulk container and, more particularly, to corner sling adapters on a bulk container.

BACKGROUND OF THE INVENTION

Bulk packaging containers have found widespread use for storage and shipment of bulk goods. The bulk packaging containers assume many different forms. Among these forms are portable tanks and intermediate bulk containers (IBC). Requirements for these types of containers are outlined in various D.O.T. and F.D.A. regulations and are particularly defined in 49CFR Section 171.8.

Among IBCs, there include numerous types of designs. These include metal IBCs, which are constructed of metal, rigid plastic IBCs which are constructed of all-plastic material, and composite IBCs which include a rigid outer package enclosing a plastic inner receptacle.

An IBC typically has a capacity in the range of 250-550 gallons. Some are as large as 793 gallons. As such, they are an efficient alternative to 55-gallon drums. Nevertheless, each IBC must be handled and transported individually when used, for example, in the export of materials. The IBC is typically loaded into a shipping vessel. Each IBC must be individually slung by a crane or carried by a forklift during the loading and unloading.

Typically when an IBC is transported by crane, a 4-legged sling is attached to the IBC's corner lifting lugs and the sling is attached to the crane and then transported, See FIG. 1. Using the normal IBC corner lifting lugs creates a lateral bending moment on the IBC corner lifting lugs when a 4-legged sling is attached and lifted from the center of the IBC with a crane. The lateral bending moment on the existing IBC corner lifting lug is created by the 4-legged sling angle when being lifted from the center of the IBC.

The present invention is directed to a corner sling adapter in a bulk container for improved handling as by eliminating lateral bending moments.

SUMMARY OF THE INVENTION

In accordance with the invention, there is provided a bulk container with corner sling adapters.

In accordance with one aspect of the invention, there is disclosed an improvement in a bulk container for storing material comprising a peripheral side wall connected to a top wall and having a lifting lug at each corner. The improvement comprises corner sling adapters mounted at each top corner. Each corner sling adapter includes a stiffener plate having a base connected to upturned sides and a padeye comprising a planar body with a through opening. The padeye planar body is secured to and extends upwardly from the base. Each corner sling adapter is fastenable to one of the corner lifting lugs whereby the padeye planar body at each top corner is substantially in-line with the padeye planar body at an opposite corner.

It is a feature of the invention to provide a reinforcing plate mounted to each side of the padeye planar body and surrounding the through opening.

It is another feature of the invention that each lifting lug comprises a generally L-shaped metal plate having first and second legs, each having a through opening and wherein the stiffener plate sides cover the leg through openings.

It is another feature of the invention that each corner sling adapter further comprises a support plate substantially parallel to the base and connected to a top edge of the padeye and to the sides. The support plates provide a support surface for legs of a bulk container to be stacked thereon, in use.

It is yet another feature of the invention that the stiffener plate sides of each corner sling adapter extend above the connected support plate to restrict movement of a stacked bulk container, in use.

It is still another feature of the invention that each corner sling adapter is of one piece construction.

It is still a further feature of the invention that each corner sling adapter is fastened to the bulk container by weld connections between the stiffener plate sides and the lifting lugs and the padeye is secured to the base and to the corner lifting lugs by weld connections.

It is still a further feature of the invention that each corner sling adapter is further fastened to the bulk container by weld connections between the stiffener plate base and the top wall of the bulk container.

It is yet another feature of the invention that the padeye is of greater thickness than the stiffener plate.

It is an additional feature of the invention that each corner sling adapter is of stainless steel construction.

There is disclosed in accordance with another aspect of the invention a bulk container for storing materials comprising a tank comprising a peripheral side wall connected to a generally rectangular top wall. A lifting lug is secured to the tank at each corner of the top wall. Each lifting lug comprises a generally L-shaped metal plate having first and second legs. A corner sling adapter is mounted at each lifting lug. Each corner sling adapter includes a stiffener plate having a base connected to upturn sides and a padeye comprising a planar body with a through opening. The padeye planar body is secured to and extends upwardly from the base. Each corner sling adapter is fastened to one of the corner lifting lugs whereby the padeye planar body at each corner of the top wall is substantially in-line with the padeye planar body at an opposite corner of the top wall.

Further features and advantages of the invention will be apparent from the specification and the drawings.

DETAILED DESCRIPTION OF THE INVENTION

The present invention relates generally to corner sling adapters used, for example, on the top corners of a portable tank, or an intermediate bulk container (IBC), or the like, for transporting and storing materials, such as liquid materials. 49CFR Section 171.8 defines a portable tank as a "bulk packaging (except a cylinder having a water capacity of 1000 pounds or less) designed primarily to be loaded onto, or on, or temporarily attached to a transport vehicle or ship and equipped with skids, mountings, or accessories to facilitate handling of the tank by mechanical means." An IBC is defined as "a rigid or flexible portable packaging, other than a cylinder or portable tank, which is designed for mechanical handling." Particularly, the corner sling adapters used on an IBC or portable tank, or the like, with other appurtenances, eliminates lateral bending moments and enhances stackability. The present invention is described relative to an IBC. However, the principals of the invention can be applied to portable tanks and the like and may be referred to herein more generally as a bulk container.

Figure 1:
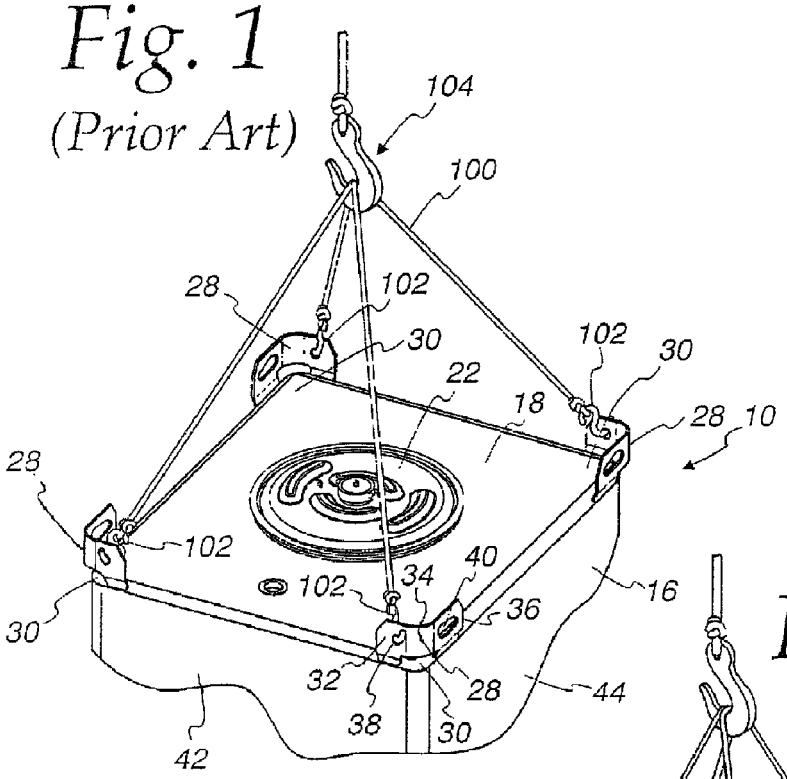
Fig. 1 (Prior Art)
FIG. 1 is a partial, perspective view of a prior art intermediate bulk container (IBC) with a 4-legged sling attached to the IBC's corner lifting lugs.
Figure 2:
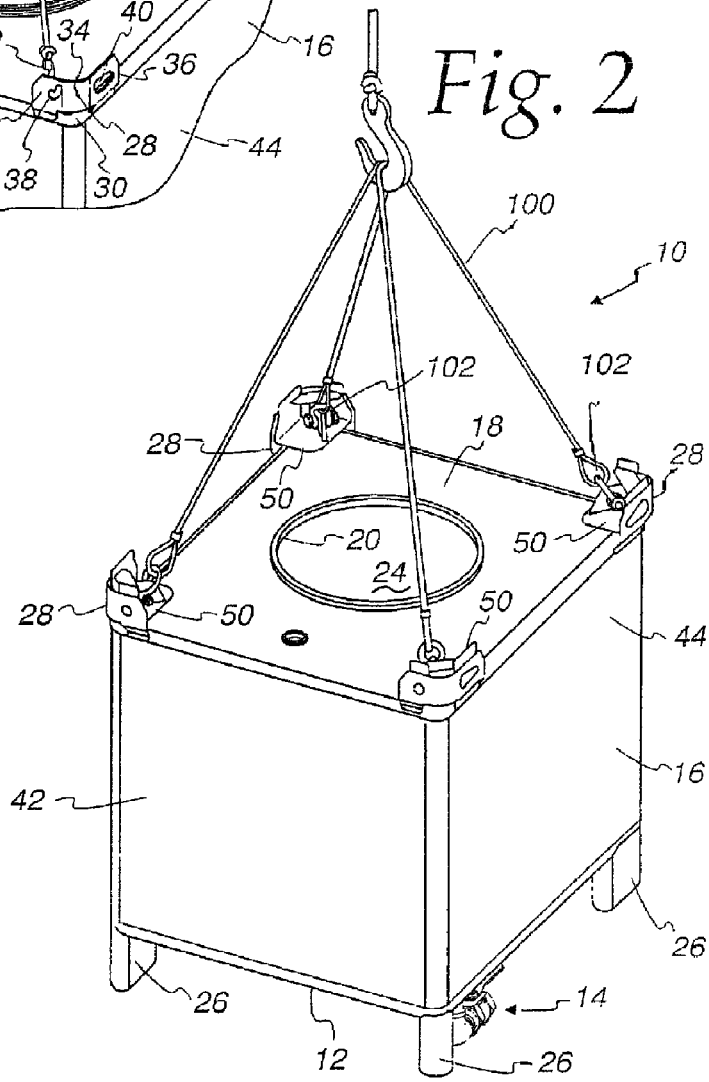
FIG. 2 is a perspective view of an IBC in accordance with the invention including corner sling adapters with a 4-legged sling attached to the corner sling adapters.

Referring to FIGS. 1 and 2, a portable tank, in the form of an IBC 10, includes a bottom head 12 equipped with a discharge assembly 14. The bottom head 12 is welded to a peripheral side wall 16 of the tank which is closed by a top wall 18. The top wall 18 includes a fill opening 20 closed by a cover 22, see FIG. 1. The fill opening 20 provides access to an internal space 24. Four formed legs 26 are provided at each corner of the bottom head 12 to support the IBC 10 on a support surface or for stacking on another IBC, as described below. A lifting lug 28 is provided at each of the four corners 30 of the top wall 18.

The top wall 18 is generally rectangular with the dimensions depending on the capacity of the IBC. As is apparent, the rectangular top wall defines the four top corners 30 which are shown as slightly rounded. Each lifting lug 28 comprises an L-shaped metal plate having a laterally extending short leg 32 and connected by a turned connecting portion 34 to a longitudinally extending longer leg 36. The shorter leg 32 includes a circular opening 38. The longer leg 36 includes a slotted opening 40. As is apparent, there are two different configurations for the lifting lug 28, one being a mirror image of the other. The different configurations are used at adjacent corners, while opposite corners use identical configurations. As such, the shorter legs 28 are along lateral sides 42 of the IBC 10 and the longer legs 36 are along longitudinal sides 44 of the IBC 10.

FIG. 1 illustrates a known prior art IBC 10 manufactured and sold by the assignee of the present invention under the trademark LIQUITOTE®. The LIQUITOTE® IBC is a steel container typically providing capacity in the range of 255 to 550 gallons, although some are as large as 793 gallons, and has a nominal width of 42 inches and nominal length of either 42 or 48 inches. The capacity is otherwise determined by height of the bulk container, which is variable. FIG. 2 illustrates the IBC 10 with corner sling adapters 50 added to the IBC 10 at each lifting lug 28. Although the corner sling adapters 50 are illustrated on the LIQUITOTE® IBC, the corner sling adapters 50 could be used with other types of IBCs, portable tanks, or the like, referred to generally as bulk containers, as will be apparent to those skilled in the art. Such containers may provide capacity in the range of 120 to 793 gallons. Also, the IBC 10 could be manufactured of rigid plastic or be of composite construction, as is known. As used herein, the term bulk container is intended to also refer more generally to IBCs and portable tanks, or the like.

The conventional 4-legged sling 100 includes a hook 102 at each end. The hooks 102 are inserted through the through openings 38 of the shorter legs 32, as shown, in FIG. 1. A crane, or the like, represented at 104, lifts the four leg sling 100 and thus the IBC 10. As discussed above, with the IBC 10 in the prior art configuration shown in FIG. 1, without corner sling adapters 50, lateral bending moments are present on the lifting lugs 30, as is apparent. The present invention is directed to improvements in IBC lifting by crane when using a 4-legged sling 100 attached to the IBC's corner sling adapters 50, see FIG. 2. The IBC corner sling adapters 50 can be retrofitted to existing customers IBC's or can be incorporated into newly manufactured IBC's.

Figure 3:
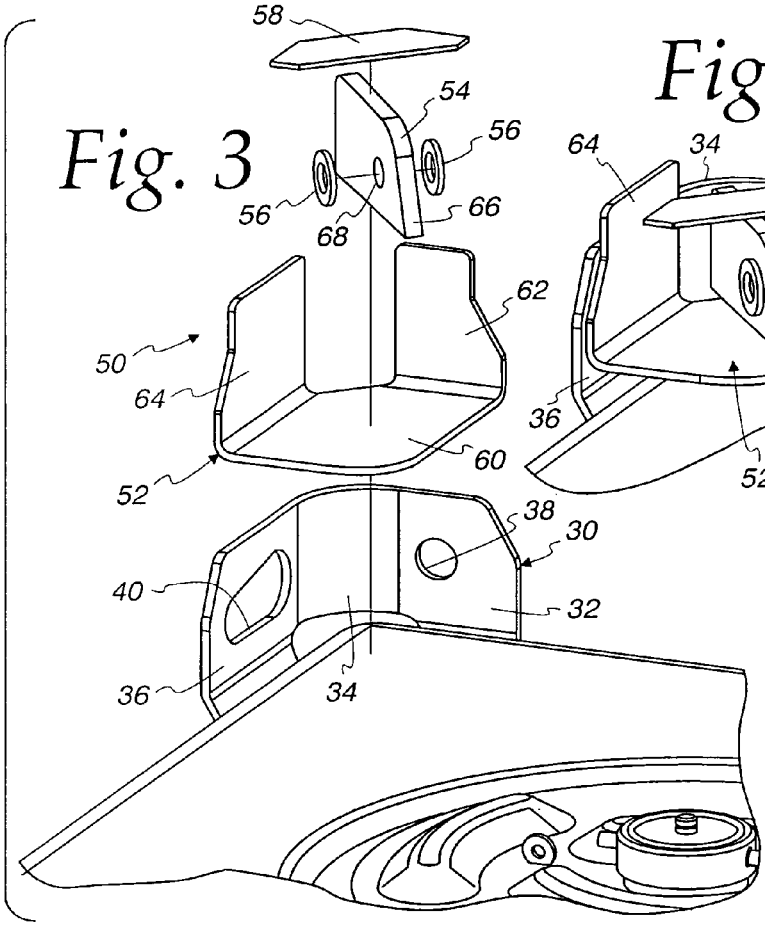
FIG. 3 is a partial, exploded view of one corner of the IBC and associated corner sling adapter of FIG. 2.
Figure 4:
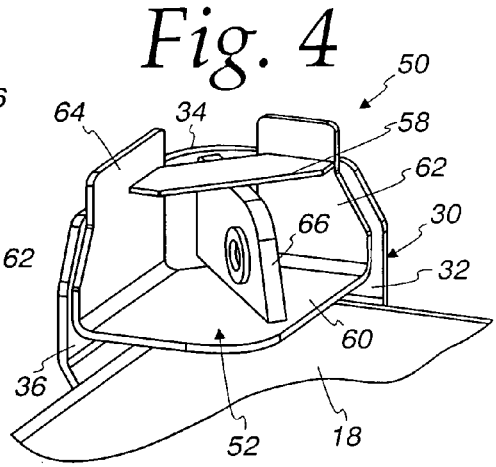
FIG. 4 is a partial, perspective, detailed view of the corner sling adapter at one top corner of the IBC of FIG. 2.

Referring to FIGS. 3 and 4, the corner sling adapter 50 includes a stiffener plate 52, a padeye 54, two reinforcing plates 56 and a support plate 58. Each of the components of the corner sling adapter 50 is of metal construction. The stiffener plate is of one piece construction and comprises a base 60 connected to upturned sides 62 and 64. The sides 62 and 64 are of a size generally corresponding to the legs 32 and 36, respectively, of the lifting lug 30, but are of a height to extend above the lifting lug 30. The stiffener plate 52 may be on the order of one quarter inch thickness. The padeye 54 comprises a planar body 66 having a through opening 68. The planar body 66 is advantageously of a greater thickness than the stiffener plate 52 and may be on the order of one half inch thickness. The reinforcing plates 56 are annular in shape, such as washers, and may have a thickness on the order of 3/16 inch. The reinforcing plates 56 are positioned on opposite sides of the planar body 66 surrounding the through opening 68 to reinforce the same. The support plate 58 comprises a planar body substantially parallel to the base 60 and adapted to sit atop the padeye 54 and extend diagonally to connect to the opposite sides 62 and 64.

Referring particularly to FIG. 4, the stiffener plate 52 is welded to the lifting lug 30. The weld connections may be between the sides 62 and 64 and the associated lifting lug legs 32 and 36, respectively. The base plate 60 may also be welded to the IBC top wall 18. The padeye 66 is welded to the stiffener plate base 60 and also to the lifting lug corner portion 34. The support plate 58 is secured as by welding to the stiffener plate sides 62 and 64 and to the padeye 54.

Figure 5:
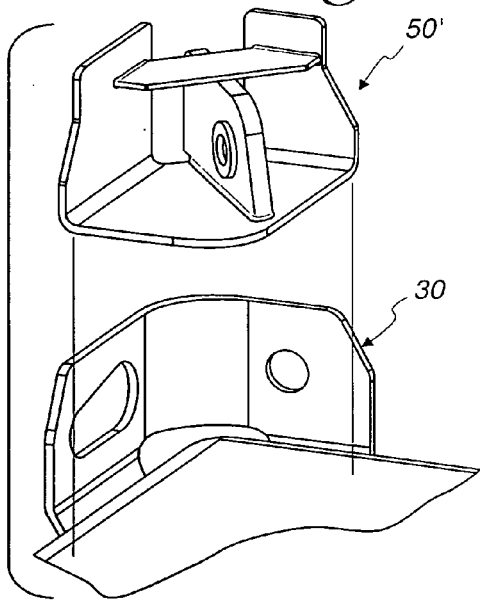
FIG. 5 is a partial, perspective, exploded view of one corner of the IBC with a corner sling adapter in accordance with another embodiment of the invention.
Figure 6:
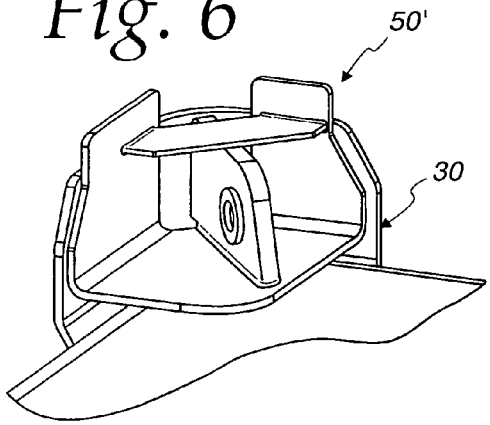
FIG. 6 is a partial, perspective view of the corner sling adapter of FIG. 5 secured to the IBC at one corner thereof.

Referring to FIG. 5, a corner sling adapter 50' according to an alternative embodiment of the invention is illustrated. The corner sling adapter 50' differs from the corner sling adapter 50, discussed above, in that the corner sling adapter 50' is integrally formed of one piece. The corner sling adapter 50' may be formed by casting. In other respects, the corner sling adapter 50' is similar to the corner sling adapter 50.

Figure 7:
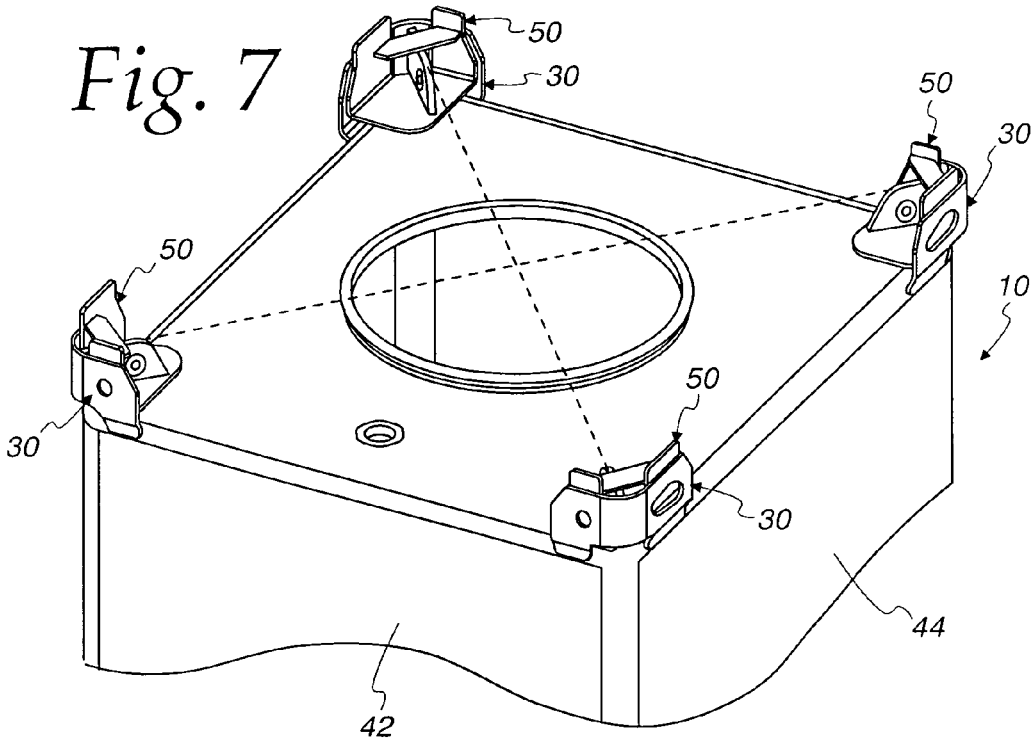
FIG. 7 is a partial, perspective view of the IBC of FIG. 2, without the four-legged sling attached.

As with the lifting lugs 30, discussed above, the corner sling adapter 50 may be provided in two different configurations, being mirror images of one another, corresponding to the structure of the lifting lugs 30. Likewise, depending upon the rectangular configuration of the top wall 18, the mounting angle of the padeye 54 at each corner 30 is selected so that each padeye 54 is in-line with the padeye 54 at an opposite corner. This is accomplished by having the angle of the padeye 54 at each corner relative to any one of the walls, being equivalent to the padeye at the adjacent corner along that same wall. For example, in one embodiment, the angle of the padeyes 50 relative to the lateral wall 42 may be on the order of 50°, while the angle of the padeyes 54 relative to the longitudinal wall 44 would be on the order of 40°. This alignment is illustrated by the dashed lines of FIG. 7.

The corner sling lifting adapters 50 increase the IBC's overall lifting capacity when using a 4-legged sling 100 attached to the corner sling lifting adapters 50 and picked up by a crane in the center of the IBC 10, see FIG. 2. The increase comes from the new corner sling adapters 50 being in-line with the pull of the 4-legged sling and the corner sling adapters 50 being of thicker material.

As is apparent in FIG. 4, the stiffener plate sides 62 and 64 being secured to the lifting lug legs 32 and 36, respectively, overlie and thus cover the respective openings 38 and 40. This eliminates the possibility of a user attaching a 4-legged sling 100 into the corner lifting lug openings 38 and/or 40. This ensures that the in-line pull, discussed above, is present by inserting the sling hooks 102 only through the reinforced padeye openings 68, as generally illustrated in FIG. 2. The corner sling adapters 50 are in-line with the pull of the 4-legged sling 100 when lifted from the center of the IBC 10. This prevents lateral bending moments present when using the existing corner lifting lugs 30, as illustrated in FIG. 1.

As apparent, the corner sling adapters do not protrude any further outside the side boundaries of the existing IBCs as they are positioned within the lifting lugs 30.

The corner sling adapters 50 are adaptable to meet certain offshore requirements stating that clearance between sling shackle pins and holes and lifting device shall not exceed 6% of the shackle pin diameter. This is done by selecting the size of the padeye opening 68 and likewise the reinforcing plates 56, as will be apparent. Likewise, the corner sling adapter 50 can be adapted to meet certain offshore requirements stating that the thickness of the lifting device at the hole shall not be less than 75% of the inside width of the joining shackle. This is accomplished by both the thickness of the padeye 54 and the reinforcing plates 56.

Figure 8:
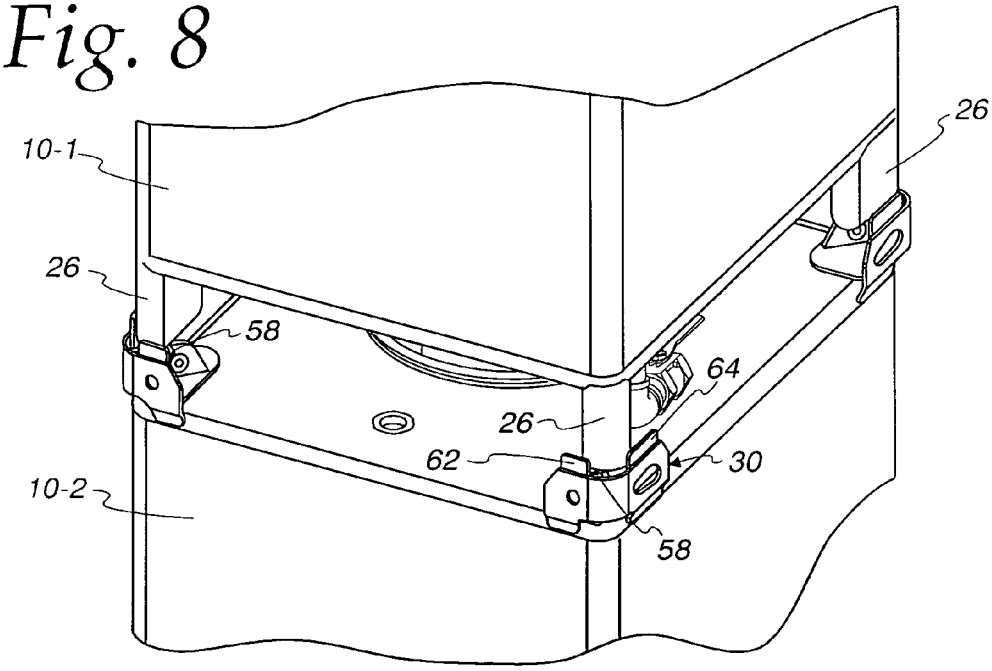
FIG. 8 is a partial, perspective view illustrating stacking of multiple IBCs using the corner sling adapters in accordance with the invention.

In accordance with the invention, the support plates 58 are adapted to support the legs 26 of an IBC 10-1 stacked atop an IBC 10-2, as shown in FIG. 8. Moreover, the sides 62 and 64 extending above the lifting lug 30 restricts sideward movement of the stacked IBC 10-1. As is apparent, if stacking is not required, then the support plate 58 can be eliminated and the stiffener plate sides 62 and 64 can be made shorter.

Thus, in accordance with the invention, there is provided a corner sling adapter 50 to be retrofit to existing IBCs 10 or manufactured with new IBCs, to improve handling as by eliminating lateral bending moments while maintaining stackability.

Holes in the existing IBC corner lifting lugs will be covered up by the corner sling adapter, see FIG. 4. This eliminates any possibility of someone attaching a 4-legged sling or chain into the old corner lifting lug holes.

Thus, in accordance with the invention, there is described a bulk container with corner sling adapters to improve handling.

We claim:

1. In a bulk container for storing materials comprising a peripheral side wall connected to a top wall and having a lifting lug at each top corner, the improvement comprising:

corner sling adapters mounted at each top corner, each corner sling adapter including a stiffener plate having a base connected to upturned sides and a padeye comprising a planar body with a through opening, the padeye planar body secured to and extending upwardly from the base, each corner sling adapter being fastenable to one of the corner lifting lugs whereby the padeye planar body at each top corner is substantially in-line with the padeye planar body at an opposite corner.

2. The improvement of claim 1 further comprising a reinforcing plate mounted to each side of the padeye planar body and surrounding the through opening.

3. The improvement of claim 1 wherein each lifting lug comprises a generally L shaped metal plate having first and second legs each having a through opening and wherein the stiffener plate sides cover the leg through openings.

4. The improvement of claim 1 wherein each corner sling adapter further comprises a support plate substantially parallel to the base and connected to a top edge of the padeye and to the sides, the support plates providing a support surface for legs of a bulk container to be stacked thereon, in use.

5. The improvement of claim 4 wherein the stiffener plate sides of each corner sling adapter extend above the connected support plate to restrict movement of a stacked bulk container, in use.

6. The improvement of claim 1 wherein each corner sling adapter is of one piece construction.

7. The improvement of claim 1 wherein each corner sling adapter is fastened to the bulk container by weld connections between the stiffener plate sides and the lifting lugs and the padeye is secured to the base and to the corner lifting lugs by weld connections.

8. The improvement of claim 7 wherein each corner sling adapter is further fastened to the bulk container by weld connections between the stiffener plate base and the top wall of the bulk container.

9. The improvement of claim 1 wherein the padeye is of greater thickness than the stiffener plate.

10. The improvement of claim 1 wherein each corner sling adapter is of stainless steel construction.

11. A bulk container for storing materials comprising:

a tank comprising a peripheral side wall connected to a generally rectangular top wall;

a lifting lug secured to the tank at each corner of the top wall, each lifting lug comprises a generally L shaped metal plate having first and second legs; and a corner sling adapter mounted at each lifting lug, each corner sling adapter including a stiffener plate having a base connected to upturned sides and a padeye comprising a planar body with a through opening, the padeye planar body secured to and extending upwardly from the base, each corner sling adapter being fastened to one of the corner lifting lugs whereby the padeye planar body at each corner of the top wall is substantially in-line with the padeye planar body at an opposite corner of the top wall.

12. The bulk container of claim 11 further comprising a reinforcing plate mounted to each side of the padeye planar body and surrounding the through opening.

13. The bulk container of claim 11 wherein each leg has a through opening and the stiffener plate sides cover the leg through openings.

14. The bulk container of claim 11 wherein each corner sling adapter further comprises a support plate substantially parallel to the base and connected to a top edge of the padeye and to the sides, the support plates providing a support surface for legs of a bulk container to be stacked thereon, in use.

15. The bulk container of claim 14 wherein the stiffener plate sides of each corner sling adapter extend above the connected support plate to restrict movement of a stacked bulk container, in use.

16. The bulk container of claim 11 wherein each corner sling adapter is of one piece construction.

17. The bulk container of claim 11 wherein each corner sling adapter is fastened to the bulk container by weld connections between the stiffener plate sides and the lifting lugs and the padeye is secured to the base and to the corner lifting lugs by weld connections.

18. The bulk container of claim 17 wherein each corner sling adapter is further fastened to the bulk container by weld connections between the stiffener plate base and the top wall of the bulk container.

19. The bulk container of claim 11 wherein the padeye is of greater thickness than the stiffener plate.

20. The bulk container of claim 11 wherein each corner sling adapter is of stainless steel construction.

21. The bulk container of claim 11 wherein the tank comprises a tank having a capacity in the range of about 120 to 793 gallons.

* * * * *